US010347180B2

(12) United States Patent
Zhu et al.

(10) Patent No.: US 10,347,180 B2
(45) Date of Patent: Jul. 9, 2019

(54) ORGANIC LIGHT-EMITTING PIXEL DRIVING CIRCUIT, DRIVING METHOD THEREOF, AND ORGANIC LIGHT-EMITTING DISPLAY PANEL

(71) Applicants: Shanghai Tianma AM-OLED Co., Ltd., Shanghai (CN); Tianma Micro-Electronics Co., Ltd., Shenzhen (CN)

(72) Inventors: Renyuan Zhu, Shanghai (CN); Yue Li, Shanghai (CN); Tong Wu, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 155 days.

(21) Appl. No.: 15/599,541

(22) Filed: May 19, 2017

(65) Prior Publication Data

US 2017/0256205 A1 Sep. 7, 2017

(30) Foreign Application Priority Data

Dec. 20, 2016 (CN) ..... 2016 1 1183670

(51) Int. Cl.
*G09G 3/3233* (2016.01)
*G09G 3/3291* (2016.01)
(Continued)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC .. G09G 3/3258; G09G 3/3233; G09G 3/3275; G09G 3/3291; G09G 3/3655; G09G 3/002; G09G 2320/0219; G09G 2320/06
See application file for complete search history.

(56) References Cited

U.S. PATENT DOCUMENTS 8,531,361 B2 9/2013 Nam
2014/0118409 A1* 5/2014 Jun ..... G09G 5/02 345/690
(Continued)

FOREIGN PATENT DOCUMENTS

CN 102568374 A 7/2012
CN 102956192 A 3/2013
(Continued)

*Primary Examiner* — Christine A Enad
(74) *Attorney, Agent, or Firm* — Anova Law Group, PLLC

(57) ABSTRACT

An organic light-emitting pixel driving circuit, a driving method thereof, and an organic light-emitting display panel are provided. The organic light-emitting pixel driving circuit comprises a light-emitting element, a driving transistor for driving the light-emitting element, an initialization unit, a storage unit, a data write-in unit, and a light-emitting control unit. The initialization unit is configured to transmit a first power supply voltage signal to a gate electrode of the driving transistor and transmit a reference voltage signal to a source electrode of the driving transistor and an anode of the light-emitting element. The storage unit is configured to maintain a voltage signal transmitted to the driving transistor. The data write-in unit is configured to transmit a data voltage signal to the gate electrode of the driving transistor, thus compensating a threshold voltage of the driving transistor. The light-emitting control unit is configured to control the light-emitting element.

20 Claims, 7 Drawing Sheets

(51) Int. Cl.

| | |
|---|---|
| ***G09G 3/3258*** | (2016.01) |
| ***G09G 3/36*** | (2006.01) |
| *G09G 3/3266* | (2016.01) |

(52) U.S. Cl.
CPC ..... *G09G 2300/0819* (2013.01); *G09G 2300/0852* (2013.01); *G09G 2300/0861* (2013.01); *G09G 2310/0262* (2013.01); *G09G 2320/0219* (2013.01); *G09G 2320/0233* (2013.01); *G09G 2320/043* (2013.01)

(56) References Cited

U.S. PATENT DOCUMENTS

| | | | | |
|---|---|---|---|---|
| 2014/0152719 | A1* | 6/2014 | Jung | G09G 3/3233 345/691 |
| 2017/0069268 | A1* | 3/2017 | Tokunaga | G09G 3/3233 |
| 2017/0178569 | A1* | 6/2017 | Hu | G09G 3/3233 |
| 2017/0337875 | A1* | 11/2017 | Jeon | G09G 3/3258 |
| 2018/0218676 | A1* | 8/2018 | He | G09G 3/3233 |
| 2018/0246614 | A1* | 8/2018 | Hu | G06F 3/0412 |
| 2018/0308424 | A1* | 10/2018 | Toyoda | G09G 3/20 |

FOREIGN PATENT DOCUMENTS

| | | | |
|---|---|---|---|
| CN | 104157234 | A | 11/2014 |
| CN | 104751789 | A | 7/2015 |
| CN | 105336296 | A | 2/2016 |
| CN | 105825815 | A | 8/2016 |
| CN | 205541822 | U | 8/2016 |
| KR | 100833756 | B1 | 5/2008 |

* cited by examiner

ORGANIC LIGHT-EMITTING PIXEL DRIVING CIRCUIT, DRIVING METHOD THEREOF, AND ORGANIC LIGHT-EMITTING DISPLAY PANEL

CROSS-REFERENCES TO RELATED APPLICATIONS

This application claims priority of Chinese Patent Application No. 201611183670.7, filed on Dec. 20, 2016, the entire contents of which are hereby incorporated by reference.

FIELD OF THE DISCLOSURE

The present disclosure generally relates to the field of display technology and, more particularly, relates to an organic light-emitting pixel driving circuit, a driving method thereof, and an organic light-emitting display panel.

BACKGROUND

With the extensive development of display technologies, the organic light-emitting diode (OLED) display is increasingly applied to various kinds of electronic devices. The OLED display often includes an organic light-emitting diode array (i.e., a pixel array) comprising a plurality of organic light-emitting diodes and a plurality of pixel driving circuits. The plurality of pixel driving circuits is configured to provide a light-emitting current to each organic light-emitting diode in the organic light-emitting diode array, such that each organic light-emitting diode may emit light.

The light-emitting brightness of the organic light-emitting diode may be directly proportional to the light-emitting current that flows through the organic light-emitting diode. Further, an existing pixel driving circuit often includes a driving transistor, and the light-emitting current generated by the existing pixel driving circuit is closely related with the threshold voltage of the driving transistor.

Because of various reasons such as fabrication process and aging, the threshold voltages of all driving transistors may not be totally the same. Further, because the threshold voltages of the driving transistors are not totally the same, the driving currents that flow through the plurality of organic light-emitting diodes in the organic light-emitting display may not be entirely the same. Accordingly, the brightness evenness of the organic light-emitting display panel in displaying images can be relatively poor.

The disclosed organic light-emitting pixel driving circuit, driving method thereof, and organic light-emitting display panel are directed to solving at least partial problems set forth above and other problems.

BRIEF SUMMARY OF THE DISCLOSURE

One aspect of the present disclosure provides an organic light-emitting pixel driving circuit. The organic light-emitting pixel driving circuit comprises a light-emitting element, a driving transistor, an initialization unit, a storage unit, a data write-in unit, and a light-emitting control unit. The driving transistor is configured to drive the light-emitting element. The initialization unit is configured to transmit a first power supply voltage signal to a gate electrode of the driving transistor and transmit a reference voltage signal to a source electrode of the driving transistor and an anode of the light-emitting element. The storage unit is configured to maintain a voltage signal transmitted to the driving transistor. The data write-in unit is configured to transmit a data voltage signal to the gate electrode of the driving transistor and allow the data voltage signal to compensate a threshold voltage of the driving transistor. The light-emitting control unit is configured to control the light-emitting element to emit light.

Another aspect of the present disclosure provides a driving method for driving an organic light-emitting pixel driving circuit. The organic light-emitting pixel driving circuit includes a light-emitting element, a driving transistor, an initialization unit under control of a first scanning signal line, a storage unit, a data write-in unit under control of a second scanning signal line, a first light-emitting control unit under control of a first light-emitting control signal line, and a second light-emitting control unit under control of a second light-emitting control signal line. The driving method comprises, in an initialization stage, providing a first voltage level signal to a first scanning signal line, a first light-emitting control signal line, and a second light-emitting control signal line, and providing a second voltage level signal to a second scanning signal line. In the initialization stage, the first light-emitting control unit and the initialization unit transmit a first power supply voltage signal to the gate electrode of the driving transistor, and the initialization unit transmits a reference voltage signal to the anode of the light-emitting element and a source electrode of the driving transistor.

Another aspect of the present disclosure provides an organic light-emitting display panel. The organic light-emitting display panel includes a plurality of rows of pixel units. Each row of the plurality of rows of pixel units comprises a plurality of organic light-emitting pixel driving circuits. An organic light-emitting pixel driving circuit comprises a light-emitting element, a driving transistor, an initialization unit, a storage unit, a data write-in unit, and a light-emitting control unit. The driving transistor is configured to drive the light-emitting element. The initialization unit is configured to transmit a first power supply voltage signal to a gate electrode of the driving transistor and transmit a reference voltage signal to a source electrode of the driving transistor and an anode of the light-emitting element. The storage unit is configured to maintain a voltage signal transmitted to the driving transistor. The data write-in unit is configured to transmit a data voltage signal to the gate electrode of the driving transistor and allow the data voltage signal to compensate a threshold voltage of the driving transistor. The light-emitting control unit is configured to control the light-emitting element to emit light.

Other aspects of the present disclosure can be understood by those skilled in the art in light of the description, the claims, and the drawings of the present disclosure.

BRIEF DESCRIPTION OF THE DRAWINGS

Other features, goals, and advantages of the present disclosure will become more apparent via a reading of detailed descriptions of non-limiting embodiments with reference to the accompanying drawings.

DETAILED DESCRIPTION

Reference will be made in detail with reference to embodiments of the present disclosure as illustrated in the accompanying drawings and embodiments. It should be understood that, specific embodiments described herein are only for illustrative purposes, and are not intended to limit the scope of the present disclosure. In addition, for ease of description, accompanying drawings only illustrate a part of, but not entire structure related to the present disclosure.

It should be noted that when there is no conflict, disclosed embodiments and features of the disclosed embodiments may be combined with each other. Hereinafter, the present disclosure is illustrated in detail with reference to embodiments thereof as illustrated in the accompanying drawings.

The present disclosure provides an organic light-emitting pixel driving circuit. Transistors included in the organic light-emitting pixel driving circuit may each be a thin film transistor, a field-effect transistor, or other elements having the same or similar properties. Further, the transistors in the disclosed organic light-emitting pixel driving circuit may each be an N-type transistor or a P-type transistor.

Hereinafter, all the transistors are assumed to be N-type transistors for illustrative purposes. It should be understood that those skilled in the art may also use P-type transistors to practice the present disclosure without creative labor.

Figure 1:
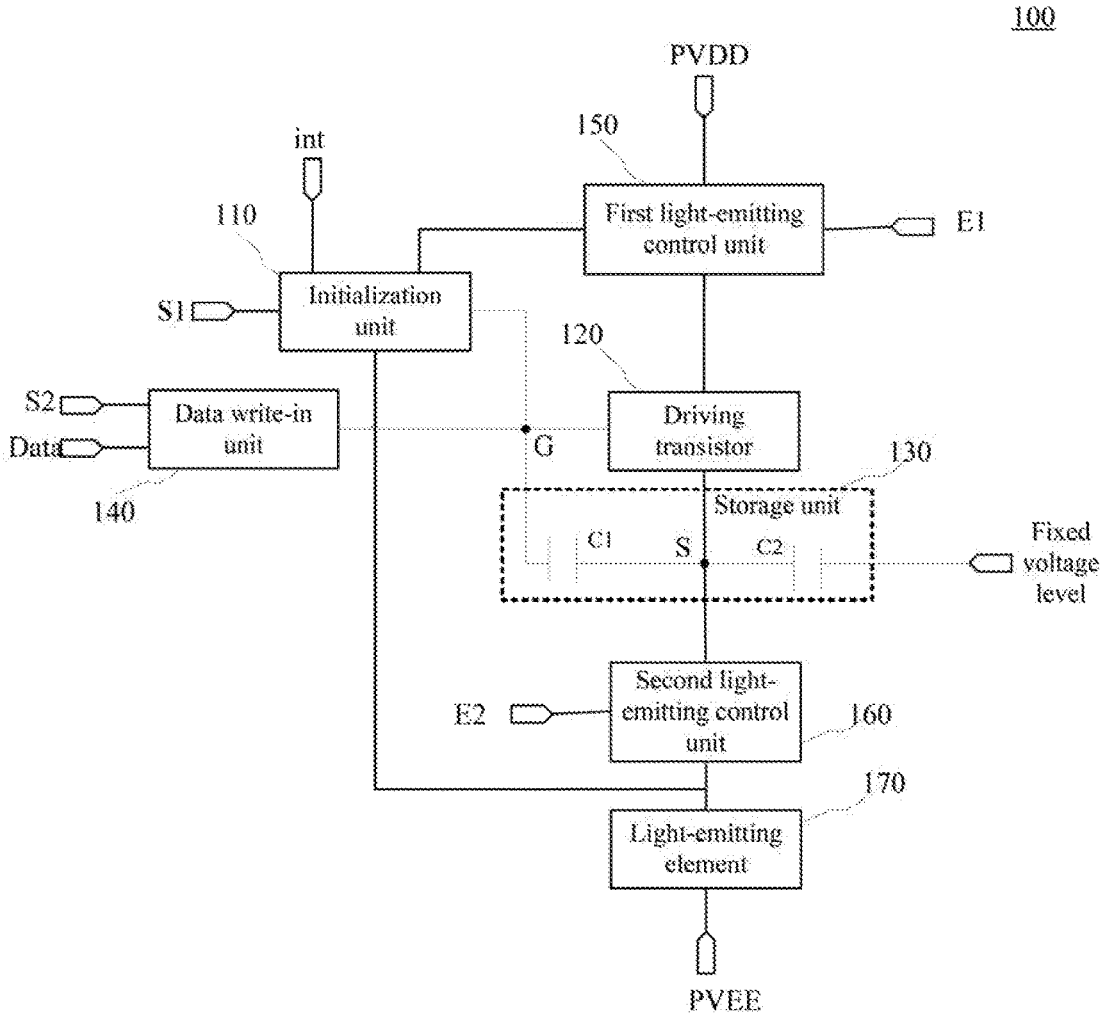
FIG. 1 illustrates an exemplary structural schematic view of an organic light-emitting pixel driving circuit according to embodiments of the present disclosure.

FIG. 1 illustrates an exemplary structural schematic view of an organic light-emitting pixel driving circuit 100 according to embodiments of the present disclosure. As shown in FIG. 1, the organic light-emitting pixel driving circuit 100 may include an initialization unit 110, a driving transistor 120, a storage unit 130, a data write-in unit 140, a first light-emitting control unit 150, a second light-emitting control unit 160, and a light-emitting element 170.

The organic light-emitting pixel driving circuit 100 may further include a first scanning signal line S1, a second scanning signal line S2, a first light-emitting control signal line E1, and a second light-emitting control signal line E2. Optionally, the organic light-emitting pixel driving circuit 100 may further include a data line Data, a reference voltage end int, a first power supply voltage end PVDD, and a second power supply voltage end PVEE.

More specifically, the first light-emitting control unit 150 may be electrically connected to the first light-emitting control signal line E1 and the first power supply voltage end PVDD. Under control of a signal transmitted by the first light-emitting control signal line E1, the first light-emitting control unit 150 may transmit a first power supply voltage signal (e.g., denoted by VDD) outputted by the first power supply voltage end PVDD to the initialization unit 110.

The initialization unit 110 may be electrically connected to the first scanning signal line S1 and the reference voltage end int. Under control of a signal carried by the first scanning signal line S1, the initialization unit 110 may transmit the first power supply voltage signal (e.g., denoted by VDD) received from the first power supply voltage end PVDD to a gate electrode G of the driving transistor 120. Further, under control of the signal carried by the first scanning signal line S1, the initialization unit 110 may transmit a reference voltage signal (e.g., denoted by Vint) outputted by the reference voltage end int to a source electrode S of the driving transistor 120 and an anode of the light-emitting element 170.

The storage unit 130 may further include a first capacitor C1 and a second capacitor C2. The first capacitor C1 may be connected between the gate electrode G and the source electrode S of the driving transistor 120. The second capacitor C2 may be connected between the source electrode S of the driving transistor 120 and a voltage end that outputs a fixed voltage signal.

For example, more specifically, a first plate of the first capacitor C1 may be connected to the gate electrode G of the driving transistor 120, and a second plate of the first capacitor C1 may be connected to the source electrode S of the driving transistor 120. A first plate of the second capacitor C2 may be connected to the source electrode S of the driving transistor 120, and a second plate of the second capacitor C2 may access a substantially fixed voltage level.

Further, the storage unit 130 may act to maintain voltage signals transmitted to the driving transistor 120 when no external voltage signal is inputted. For example, when no external signal is inputted, the storage unit 130 may be configure to maintain the voltage signal transmitted to the gate electrode G of the driving transistor 120.

The data write-in unit 140 may be connected to the data line Data and the second scanning signal line S2. Under control of a signal carried by the second scanning signal line S2, the data write-in unit 140 may transmit a data voltage signal (e.g., denoted by Vdata) carried by the data line Data to the gate electrode G of the driving transistor 120.

Further, the data voltage signal transmitted to the gate electrode G of the driving transistor 120 may compensate the threshold voltage (e.g., denoted by Vth) of the driving transistor 120, such that a light-emitting current (also called driving current) generated by the driving transistor 120 may not be affected by the threshold voltage of the driving transistor 120.

That is, when flowing through light-emitting elements, the light-emitting current may not vary with the variation in the threshold voltage of the driving transistors 120. More specifically, the light-emitting current generated by the driving transistor 120 may be, for example, related to the first power supply voltage signal and the data voltage signal.

The second light-emitting control unit 160 may be connected to the second light-emitting control signal line E2. Together with the first light-emitting control unit 150, the second light-emitting control unit 160 may be configured to control the light-emitting element 170 to emit light. That is, the first light-emitting control unit 150 and the second light-emitting control unit 160 may be configured to control whether the light-emitting element 170 emits light or not.

A cathode of the light-emitting element 170 may be connected to the second power supply voltage end PVEE. Further, the voltage level of the reference voltage signal outputted by the reference voltage end int may need to be lower than the voltage level of the second power supply voltage outputted by the second power supply voltage end PVEE. Accordingly, the anode of the light-emitting element 170 may be reset when the reference voltage signal is inputted to the anode of the light-emitting element 170. In one embodiment, the light-emitting element 170 may be an organic light-emitting diode.

Optionally, in some embodiments, the first light-emitting control signal line E1 may be connected to the second scanning signal line S2 via a phase inverter. Accordingly, the first light-emitting control signal may be generated by connecting a generation circuit of the second scanning signal carried by the second scanning signal line S2 to the phase inverter. Thus, the generation circuit of the first light-emitting control signal may be simplified to reduce the layout area occupied by the organic light-emitting pixel driving circuit.

In the disclosed organic light-emitting pixel driving circuit, the initialization unit 110 may be configured to transmit the first power supply voltage signal to the gate electrode G of the driving transistor 120. The driving transistor 120 may be configured to drive the light-emitting element 170. The storage unit 130 may be configured to maintain the voltage signals transmitted to the driving transistor 120.

Further, the data write-in unit 140 may be configured to transmit the data voltage signal carried by the data line Data to the gate electrode G of the driving transistor 120 and compensate the threshold voltage of the driving transistor 120. The first light-emitting control unit 150 and the second light-emitting control unit 160 may be configured to control the light-emitting element 170 to emit light.

Accordingly, by using the disclosed organic light-emitting pixel driving circuit, the light-emitting current that flows through the light-emitting element 170 may be configured to be unrelated to the threshold voltage of the driving transistor 120. Thus, when using the organic light-emitting display panel comprising a plurality of disclosed organic light-emitting pixel driving circuits, the phenomenon of uneven display brightness induced by variance in the threshold voltage of each driving transistor avoided.

Figure 2:
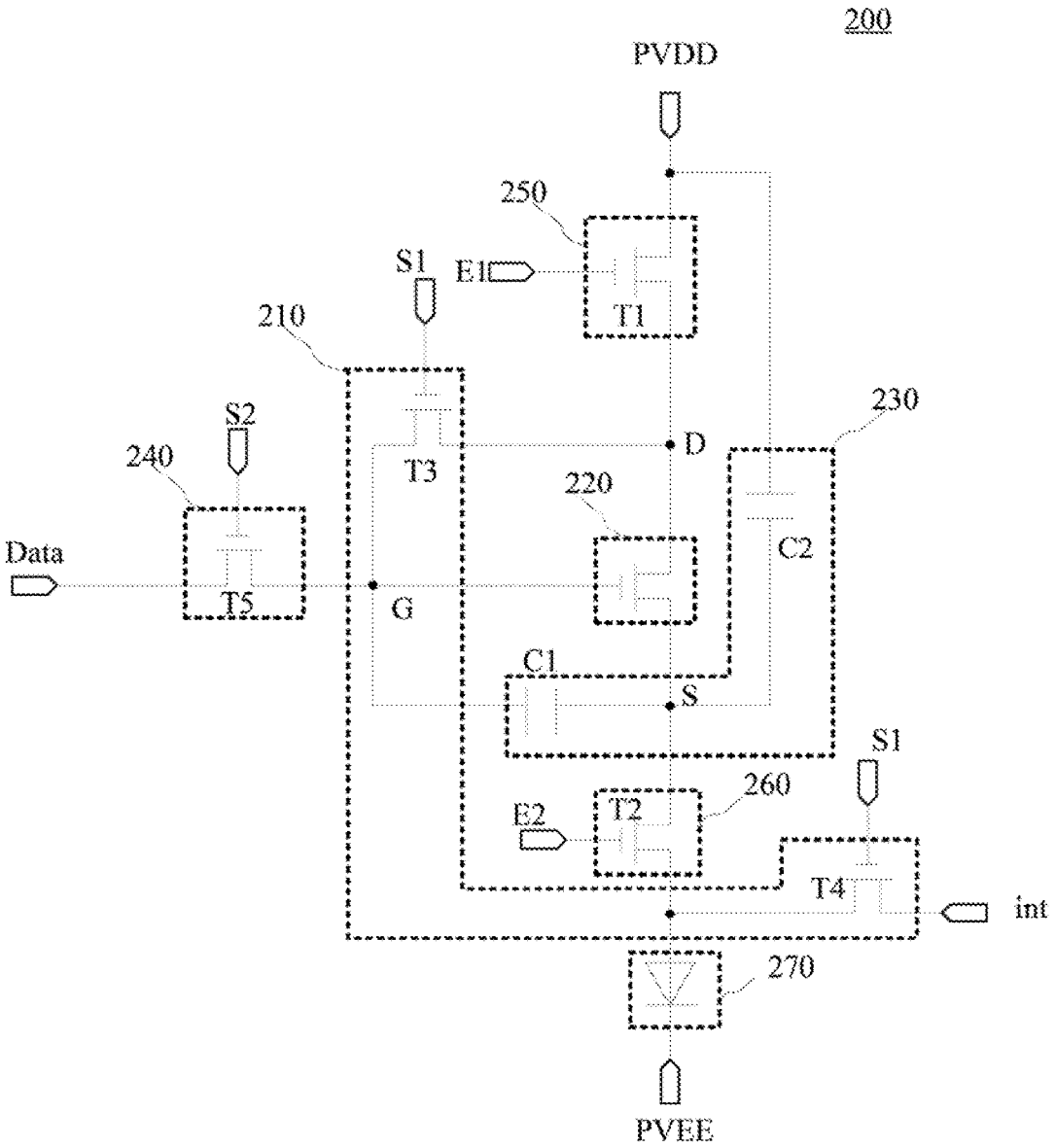
FIG. 2 illustrates another exemplary structural schematic view of an organic light-emitting pixel driving circuit according to embodiments of the present disclosure.

FIG. 2 illustrates another exemplary structural schematic view of an organic light-emitting pixel driving circuit 200 according to embodiments of the present disclosure. As shown in FIG. 2, similar to FIG. 1, the organic light-emitting pixel driving circuit 200 may include an initialization unit 210, a driving transistor 220, a storage unit 230, a data write-in unit 240, a first light-emitting control unit 250, a second light-emitting control unit 260, and a light-emitting element 270.

The organic light-emitting pixel driving circuit 200 may further include a first scanning signal line S1, a second scanning signal line S2, a first light-emitting control signal line E1, and a second light-emitting control signal line E2. Optionally, the organic light-emitting pixel driving circuit 200 may further include a data line Data, a reference voltage end int, a first power supply voltage end PVDD, and a second power supply voltage end PVEE.

Optionally, in some embodiments, the light-emitting element 270 may be an organic light-emitting diode. A cathode of the light-emitting element 270 may be connected to the second power supply voltage end PVEE.

More specifically, as shown in FIG. 2, the initialization unit 210 may be electrically connected to the first scanning signal line S1 and the reference voltage end int. Under control of a signal carried by the first scanning signal line S1, the initialization unit 210 may transmit the first power supply voltage signal outputted by the first power supply voltage end PVDD to a gate electrode G of the driving transistor 220. The first power supply voltage signal may be denoted by VDD.

Further, under control of the signal carried by the first scanning signal line S1, the initialization unit 210 may transmit a reference voltage signal outputted by the reference voltage end int to a source electrode S of the driving transistor 220 and an anode of the light-emitting element 270. The reference voltage signal may be denoted by Vint.

The storage unit 230 may include a first capacitor C1 and a second capacitor C2. The first capacitor C1 may be connected between the gate electrode G and the source electrode S of the driving transistor 220. The second capacitor C2 may be connected between the source electrode S of the driving transistor 220 and the first power supply voltage end PVDD. The storage unit 230 may be configured to detect a threshold voltage of the driving transistor 220. Further, the storage unit 230 may be configured to maintain voltage signals transmitted to the driving transistor 220.

More specifically, referring to FIG. 2, in the first capacitor C1 and the second capacitor C2 included in the storage unit 230, a first plate of the first capacitor C1 may be connected to the gate electrode G of the driving transistor 220, and a second plate of the first capacitor C1 may be connected to the source electrode S of the driving transistor 220. A first plate of the second capacitor C2 may be connected to the second plate of the first capacitor C1, and a second plate of the second capacitor C2 may be connected to the first power supply voltage end PVDD.

The data write-in unit 240 may be connected to the data line Data and the second scanning signal line S2. Under control of a signal carried by the second scanning signal line S2, the data write-in unit 240 may transmit a data voltage signal carried by the data line Data to the gate electrode G of the driving transistor 220 to compensate a threshold voltage of the driving transistor 220. The data voltage signal may be, for example, denoted by Vdata.

The first light-emitting control unit 250 may be electrically connected to the first light-emitting control signal line E1 and a drain electrode D of the driving transistor 220. The second light-emitting control unit 260 may be electrically connected to the second light-emitting control signal line E2 and the source electrode of the driving transistor 220. The first light-emitting control unit 250 and the second light-emitting control unit 260 may be configured to control whether the light-emitting element 270 emits light or not.

Different from the organic light-emitting pixel driving circuit 100 illustrated in FIG. 1, as shown in FIG. 2, specific structures of the initialization unit 210, the storage unit 230, the data write-in unit 240, the first light-emitting control unit 250, and the second light-emitting control unit 260 included in the organic light-emitting pixel driving circuit 200 are described in detail hereinafter.

For example, the first light-emitting control unit 250 may include a first transistor T1. A gate electrode of the first transistor T1 may be electrically connected to the first light-emitting control signal line E1, a first electrode of the first transistor T1 may be connected to the first power supply voltage end PVDD, and a second electrode of the first transistor T1 may be connected to a drain electrode D of the driving transistor DT.

As such, when the first transistor T1 is turned on under control of the signal carried by the first light-emitting control signal line E1, the turned on first transistor T1 may transmit the first power supply voltage signal outputted by the first power supply voltage end PVDD to the drain electrode D of the driving transistor 220.

The second light-emitting control unit 260 may include a second transistor 1'2. A gate electrode of the second transistor T2 may be connected to the second light-emitting control signal line E2, a first electrode of the second transistor T2 may be connected to the source electrode S of the driving transistor 220, and a second electrode of the second transistor 12 may be connected to the anode of the light-emitting element 270.

The initialization unit 210 may include a third transistor T3 and a fourth transistor T4. A gate electrode of the third transistor T3 may be connected to the first scanning signal line S1, a first electrode of the third transistor T3 may be connected to the second electrode of the first transistor T1, and a second electrode of the third transistor T3 may be connected to the gate electrode of the driving transistor 220.

Thus, when the first transistor T1 and the third transistor T3 are both turned on, the first transistor T1 may transmit the first power supply voltage signal outputted by the first power supply voltage end PVDD to the drain electrode D of the driving transistor 220 and the first electrode of the third transistor T3. The third transistor T3 may further transmit the first power supply voltage signal arrived at the first electrode of the third transistor T3 to the gate electrode G of the driving transistor 220 and charge the first plate of the first capacitor C1. Because of the storage function of the first capacitor C1, the voltage level of the gate electrode of the driving transistor 220 may remain to be equal to the voltage level of the first power supply voltage signal.

A gate electrode of the fourth transistor T4 may be connected to the first scanning signal line S1, and a first electrode of the fourth transistor T4 may be connected to the reference voltage end int. Further, a second electrode of the fourth transistor T4 may be connected to the anode of the light-emitting element 270 and the second electrode of the second transistor T2.

As such, under control of the signal carried by the first scanning signal line S1, the fourth transistor T4 may transmit the reference voltage signal outputted by the reference voltage end int to the anode of the light-emitting element 270. Accordingly, the light-emitting element 270 may be resetted.

Further, when the fourth transistor T4 and the second transistor 12 are both turned on, the reference voltage signal outputted by the reference voltage end int may be transmitted to the source electrode S of the driving transistor 220 via the fourth transistor T4 and the second transistor T2. Further, the voltage level of the second plate of the first capacitor C1 and the voltage level of the first plate of the second capacitor C2 may be equal to the voltage level of the reference voltage signal.

The data write-in unit 240 may include a fifth transistor T5. A gate electrode of the fifth transistor T5 may be connected to the second scanning signal line S2, a first electrode of the fifth transistor T5 may be connected to the data line Data, and a second electrode of the fifth transistor T5 may be connected to the gate electrode G of the driving transistor 220. Under control of the second scanning signal line S2, the fifth transistor T5 may be turned on to transmit the data voltage signal carried by the data line Data to the gate electrode G of the driving transistor 220 and the first plate of the first capacitor C1.

As shown in FIG. 2, the first transistor T1, the second transistor T2, the third transistor T3, the fourth transistor T4, the fifth transistor T5, and the driving transistor 220 may all assumed to be N-type transistors (e.g., NMOS transistors) for illustrative purposes. In other embodiments, the first to the fifth transistors (T1-T5) and the driving transistor 220 may all be P-type transistors (e.g., PMOS transistors), or partially N-type transistors and partially P-type transistors.

Figure 3:
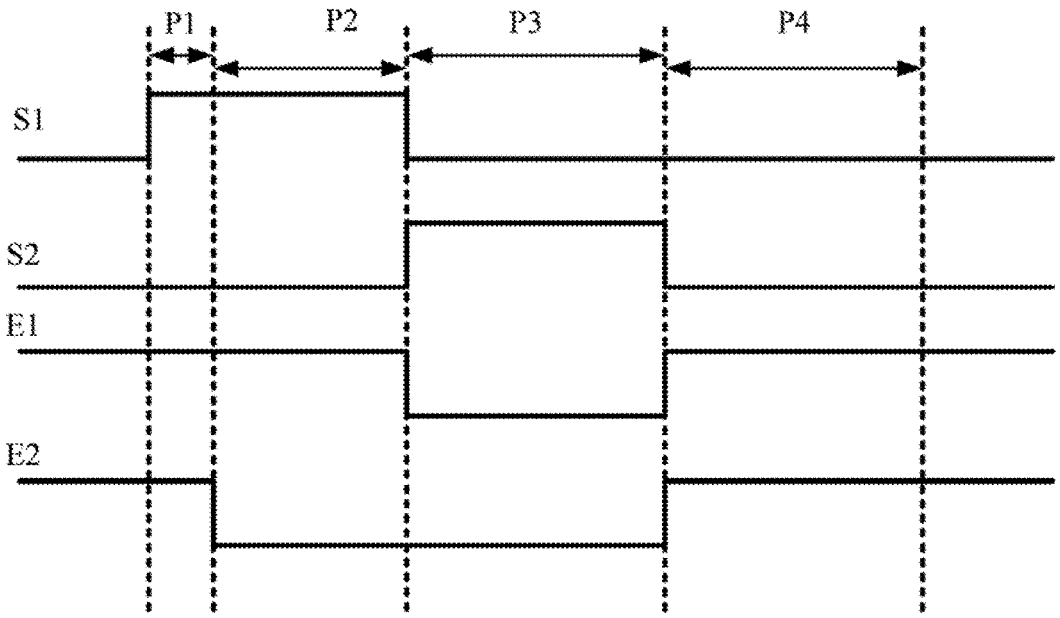
FIG. 3 illustrates an exemplary timing sequence for driving an organic light-emitting pixel driving circuit in FIG. 2.

FIG. 3 illustrates an exemplary timing sequence for driving an organic light-emitting pixel driving circuit according to embodiments of the present disclosure. For example, the timing sequence in FIG. 3 may be applied to drive the organic light-emitting pixel driving circuit shown in FIG. 2. Thus, the working principles of the organic light-emitting pixel driving circuit 200 may be illustrated in detail with reference to the timing sequence illustrated in FIG. 3. Referring to FIG. 2, the first to the fifth transistors (T1~T5) and the driving transistor 220 may be all assumed as N-type transistors hereinafter for illustrative purposes.

Correspondingly, in one embodiment, the first voltage level signal VDD may be assumed as a signal with a fixed high voltage level, and the second voltage level signal VEE may be assumed as a signal with a fixed low voltage level for illustrative purposes. However, the present disclosure is not intended to be limiting.

As shown in FIG. 3, the timing sequence may include a first stage P1, a second stage P2, a third stage P3, and a fourth stage P4. In the first stage P1, a high voltage level signal may be supplied to the first scanning signal line S1, the first light-emitting control signal line E1, and the second light-emitting control signal line E2. Accordingly, the first transistor T1, the second transistor T2, the third transistor T3, and the fourth transistor T4 may be turned on. Further, in the first stage P1, a low voltage level signal may be supplied to the second scanning signal line S2, thereby turning off the fifth transistor T5.

Further, in the first stage P1, because the first transistor T1 is turned on, the first power supply voltage signal VDD outputted by the first power supply voltage end PVDD may be transmitted to the drain electrode D of the driving transistor 220. Because the third transistor T3 is turned on, the first power supply voltage signal VDD may be further transmitted to the gate electrode G of the driving transistor 220. Accordingly, the driving transistor 220 may be turned on. Further, the first power supply voltage signal VDD may arrive at the first plate of the first capacitor C1, thereby charging the first capacitor C1.

Because of the storage function of the first capacitor C1, the voltage level of a signal transmitted to the gate electrode G of the driving transistor 220 may be maintained. That is, in the first stage P1, the voltage level of the gate electrode G of the driving transistor 220 may be equal to VDD (i.e., $V_{G1}$=VDD), where $V_{G1}$ denotes the voltage level of the gate electrode G of the driving transistor 220 in the first stage P1.

Further, in the first stage P1, because the fourth transistor T4 is turned on, a reference voltage signal Vint outputted by the reference voltage end int may be transmitted to the anode of the light-emitting element 270, thereby resetting the light-emitting element 270. Because the second transistor T2 is also turned on, the reference voltage signal Vint may be further transmitted to the source electrode S of the driving transistor 220.

Accordingly, the voltage level $V_{S1}$ of the source electrode S of the driving transistor 220 may be equal to Vint (i.e., $V_{S1}$=Vint), where $V_{S1}$ denotes the voltage level of the source electrode S of the driving transistor 220 in the first stage P1. Because the second plate of the first capacitor C1 and the first plate of the second capacitor C2 are connected to the source electrode S of the driving transistor 220, the voltage level of the second plate of the first capacitor C1 and the voltage level of the first plate of the second capacitor C2 may be equal to the voltage level of the source electrode S.

In the second stage P2, a high voltage level signal may be supplied to the first scanning signal line S1 and the first light-emitting control signal line E1, thereby turning on the first transistor T1, the third transistor T3, and the fourth transistor T4. A low voltage level signal may be supplied to the second scanning signal line S2 and the second light-emitting control signal line E2, thereby turning off the second transistor T2 and the fifth transistor T5.

By then, via a path formed by the first transistor T1 and the third transistor T3 that are turned on, the first power supply voltage signal VDD outputted by the first power supply voltage end PVDD may still be transmitted to the gate electrode G of the driving transistor 220 and the first plate of the first capacitor C1, thereby turning on the driving transistor 220. Accordingly, the voltage level of the gate electrode G of the driving transistor 220 may still be equal to the voltage level of the first power supply voltage signal VDD. That is, $V_{G2}$=VDD, where $V_{G2}$ is the voltage level of the gate electrode G of the driving transistor 220 in the second stage P2.

Though in the second stage P2, the fourth transistor T4 is turned on, because the second transistor T2 is turned off, the path that transmits the reference voltage signal Vint to the source electrode S of the driving transistor 220 may be cut off.

Further, in the second stage P2, via a path formed by the first transistor T1 and the driving transistor 220 that are turned on, the first power supply voltage signal VDD may be transmitted to the source electrode S of the driving transistor 220, thereby raising the voltage level of the source electrode S of the driving transistor 220. Because the second plate of the first capacitor C1 and the first plate of the second capacitor C2 are connected to the source electrode S of the driving transistor 220, the voltage level of second plate of the first capacitor C1 and the voltage level of the first plate of the second capacitor C2 may also be raised.

Once the difference in the voltage level between the source electrode S of the driving transistor 220 and the gate electrode G of the driving transistor 220 is equal to the threshold voltage of driving transistor 220, the driving transistor 220 may be turned off. By then, the voltage level of the source electrode S of the driving transistor 220 may no longer be raised and may remain to be VDD−|Vth|, where Vth is the threshold voltage of the driving transistor 220. That is, $V_{S2}$=VDD−|Vth|, where $V_{S2}$ is the voltage level of the source electrode of the driving transistor 220 in the second stage P2.

Further, because the fourth transistor T4 is turned on, the reference voltage signal outputted by the reference voltage end int may be transmitted to the anode of the light-emitting element 270 via the turned on fourth transistor 14. By then, the light-emitting element 270 may still not emit light.

In the third stage P3, the high voltage level signal may be supplied to the second scanning signal line S2, thereby turning on the fifth transistor T5. Further, a low voltage level signal may be supplied to the first scanning signal line S1, the first light-emitting control signal line E1, and the second light-emitting control signal line E2. Accordingly, the first transistor T1, the second transistor T2, the third transistor T3, and the fourth transistor T4 may be turned off. Further, the driving transistor 220 may remain to be turned off.

Further, in the third stage, the data voltage signal carried by the data line Data may be transmitted to the gate electrode G of the driving transistor 220. Accordingly, the voltage level of the gate electrode G of the driving transistor 220 may be equal to Vdata. That is, $V_{G3}$=Vdata, where $V_{G3}$=Vdata is the voltage level of the gate electrode G of the driving transistor 220 in the third stage P3.

By then, the first plate of the first capacitor C1 may be connected to the data line Data via the fifth transistor T5, and the second plate of the first capacitor C1 may be coupled to the first plate of the second capacitor C2. Further, the second plate of the second capacitor C2 may be connected to the first power supply voltage end PVDD.

Accordingly, when the second stage P2 switches to the third stage P3, the voltage level of the first plate of the first capacitor C1 may change from a voltage level of the first power supply voltage signal VDD to the data voltage signal Vdata. Further, in the third stage P3, under the coupling effect of the first capacitor C1 and the second capacitor C2, the voltage level $V_{S3}$ of the source electrode S of the driving transistor 220 may vary, where $V_{S3}$ represents the voltage level of the source electrode S of the driving transistor 220 in the third stage P3.

More specifically, because the signal arrived at the first plate (e.g., denoted by C11) of the first capacitor C1 changes from the first power supply voltage signal VDD in the second stage P2 to the data voltage signal Vdata in the third stage P3, the quantity of electric charges stored in the first plate of the first capacitor C1 may change correspondingly. Further, because the second plate of the second capacitor C2 stays connected to the first power supply voltage end PVDD, the quantity of electric charges stored in the second plate of the second capacitor C2 may remain unchanged.

Accordingly, the sum of the electric charge variance ΔQ12 at the second plate of the first capacitor C1 and the electric charge variance ΔQ21 at the first plate of the second capacitor C2 may be equal to the equal to the electric charge variance ΔQ11 at the first plate of the first capacitor C1. That is, the following equations are valid:

$$\Delta Q12+\Delta Q21=\Delta Q11 \tag{1}$$

Where:

$$\Delta Q11=c1\times(V\text{data}-VDD) \tag{2}$$

$$\Delta Q12=(V_{S3}-V_{S2})\times c1 \tag{3}$$

$$\Delta Q21=(V_{S3}-V_{S2})\times c2 \tag{4}$$

In the aforementioned equations (2)~(4), c1 represents the capacitance value of the first capacitor C1, and c2 represents the capacitance value of the second capacitor C2. Further, when $V_{S2}$=VDD−|Vth| and equations (2)~(4) are substituted into equation (1), an equation (5) may be obtained as follows:

$$V_{S3}=\frac{c1}{c1+c2}(Vdata-VDD)+VDD-|Vth| \tag{5}$$

That is, the voltage level $V_{S3}$ of the source electrode S of the driving transistor 220 in the third stage P3 may be equal to (c1/(c1+c2))·(Vdata−VDD)+VDD−|Vth|.

In the fourth stage P4, the high voltage level signal may be supplied to the first light-emitting control signal line E1 and the second light-emitting control signal line E2, thereby turning on the first transistor T1 and the second transistor T2. The low voltage level signal may be supplied to the first scanning signal line S1 and the second scanning signal line, thereby turning off the third transistor T3, the fourth transistor T4, and the fifth transistor T5. Because of the existence of first capacitor C1 in the pixel driving circuit 200, the driving transistor 220 may remain to be turned on.

Because the first transistor T1, the second transistor T2, and the driving transistor 220 are turned on, the light-emitting element 270 may emit light. When the light-emitting element 270 emits light, the voltage difference between two ends (i.e., the anode and the cathode) of the light-emitting element 270 may be denoted by Voled. Thus, the voltage level at the anode of the light-emitting element 270 may be equal to VEE+Voled. That is, $V_{S4}$=VEE+Voled, where $V_{S4}$ is the voltage level of the source electrode S of the driving transistor 220 in the fourth stage P4.

By then, the first plate of the first capacitor C1 may be floated. Further, when the third stage T3 is transitioned to the fourth stage P4, the voltage level of the second plate of the first capacitor C1 may be changed. More specifically, the variance in the voltage level of the second plate of the first capacitor C1 may be represented using an equation (6) as follows.

$$V_{S4} - V_{S3} = VEE + Voled - \left(\frac{c1}{c1 + c2}(Vdata - VDD) + VDD - |Vth|\right) \quad (6)$$

Because the voltage level of the second plate of first capacitor C1 changes, the quantity of electric charges at the first plate of the first capacitor C1 may change correspondingly. Further, in the first capacitor C1, the electric charge variance at the first plate may be equal to the electric charge variance at the second plate.

That is, in the first capacitor C1, the variance in the voltage level of the first plate may be equal to the variance in the voltage level of the second plate. In other words, the variance in the voltage level of the gate electrode G of the driving transistor 220 may be equal to the variance in the voltage level of the source electrode S of the driving transistor 220, as shown in an equation (7) below.

$$V_{G4} - V_{G3} = V_{S4} - V_{S3} \quad (7)$$

Further, if $V_{G3}$=Vdata and the equation (6) are substituted into the equation (7), the following equation may be obtained:

$$V_{G4} = VEE + Voled - \left(\frac{c1}{c1 + c2}(Vdata - VDD) + VDD - |Vth|\right) + Vdata$$

If simplified, an equation (8) regarding the expression of $V_{G4}$ may be obtained as follows:

$$V_{G4} = VEE + Voled + \frac{c2}{c1 + c2}(Vdata - VDD) + |Vth| \quad (8)$$

Based on the light-emitting equation, in the fourth stage P4, the light-emitting current I that flows through the light-emitting element 270 may be expressed using an equation (9) as follows:

$$I = k(V_{GS} - |Vth|)^2 = k(V_{G4} - V_{S4} - |Vth|)^2 \quad (9)$$

Further, if $V_{S4}$=VEE+Voled and equation (8) is substituted into equation (9), an equation (10) regarding the expression of the light-emitting current may be obtained as follows:

$$I = k\left(\frac{c2}{c1 + c2}(Vdata - VDD)\right)^2 \quad (10)$$

Where k is a parameter related to the width-to-length ratio of the driving transistor 220. Referring to equation (10), the light-emitting current I may be unrelated to the threshold voltage Vth of the driving transistor 220. Accordingly, when the proportional relationship between the capacitance value c1 of the first capacitor C1 and the capacitance value c2 of the second capacitor C2 remains unchanged, the same light-emitting current I may be obtained as long as the same data voltage signal Vdata and the same first power supply voltage signal VDD are supplied to the disclosed organic light-emitting pixel driving circuit.

Thus, the impact on the light-emitting current I induced by the threshold voltage of the driving transistor 220 may be avoided. Optionally, the disclosed organic light-emitting pixel driving circuit may be applied to an organic light-emitting display panel. Because the light-emitting current I in the disclosed organic light-emitting pixel driving circuit is not related to the threshold voltage of the driving transistor 220, phenomena such as uneven brightness of a display image induced by variance in the threshold voltage of the driving transistor 220 may not occur.

On the other hand, the light-emitting current I may be adjusted by varying the proportional relationship between the capacitance value c1 of the first capacitor C1 and the capacitance value c2 of the second capacitor C2. Accordingly, the light-emitting brightness of the organic light-emitting element (e.g., an organic light-emitting diode) may be adjusted. Optionally, the proportional relationship between the capacitance value c1 of the first capacitor C1 and the capacitance value c2 of the second capacitor C2 may be configured based on the usage environment of the organic light-emitting display panel.

In one embodiment, the capacitance value c2 of the second capacitor C2 may be configured to be greater than the capacitance value c1 of the first capacitor C1. Thus, according to equation (10), the driving transistor 220 in the disclosed organic light-emitting pixel driving circuit may generate a relatively large light-emitting current.

Accordingly, when the same first power supply voltage signal and the same data voltage signal are supplied to the disclosed organic light-emitting pixel driving circuit, by configuring the capacitance value c2 of the second capacitor C2 to be greater than the capacitance value c1 of the first capacitor C1, a relatively high brightness may be obtained. Accordingly, the power consumption may be decreased.

Further, from the timing sequence illustrated in FIG. 3, the signal carried by the first light-emitting control signal line E1 and the signal carried by the second scanning signal line S2 may be phase-reversed. Accordingly, the second scanning signal line S2 may be connected to the first light-emitting control signal line E1 via a phase inverter. That is, by connecting a circuit that generates the signal carried by the second scanning signal line S2 to a phase inverter, the signal carried by the first light-emitting control signal line E1 may be generated. Thus, the layout area occupied by the organic light-emitting pixel driving circuit may be reduced.

Figure 4:
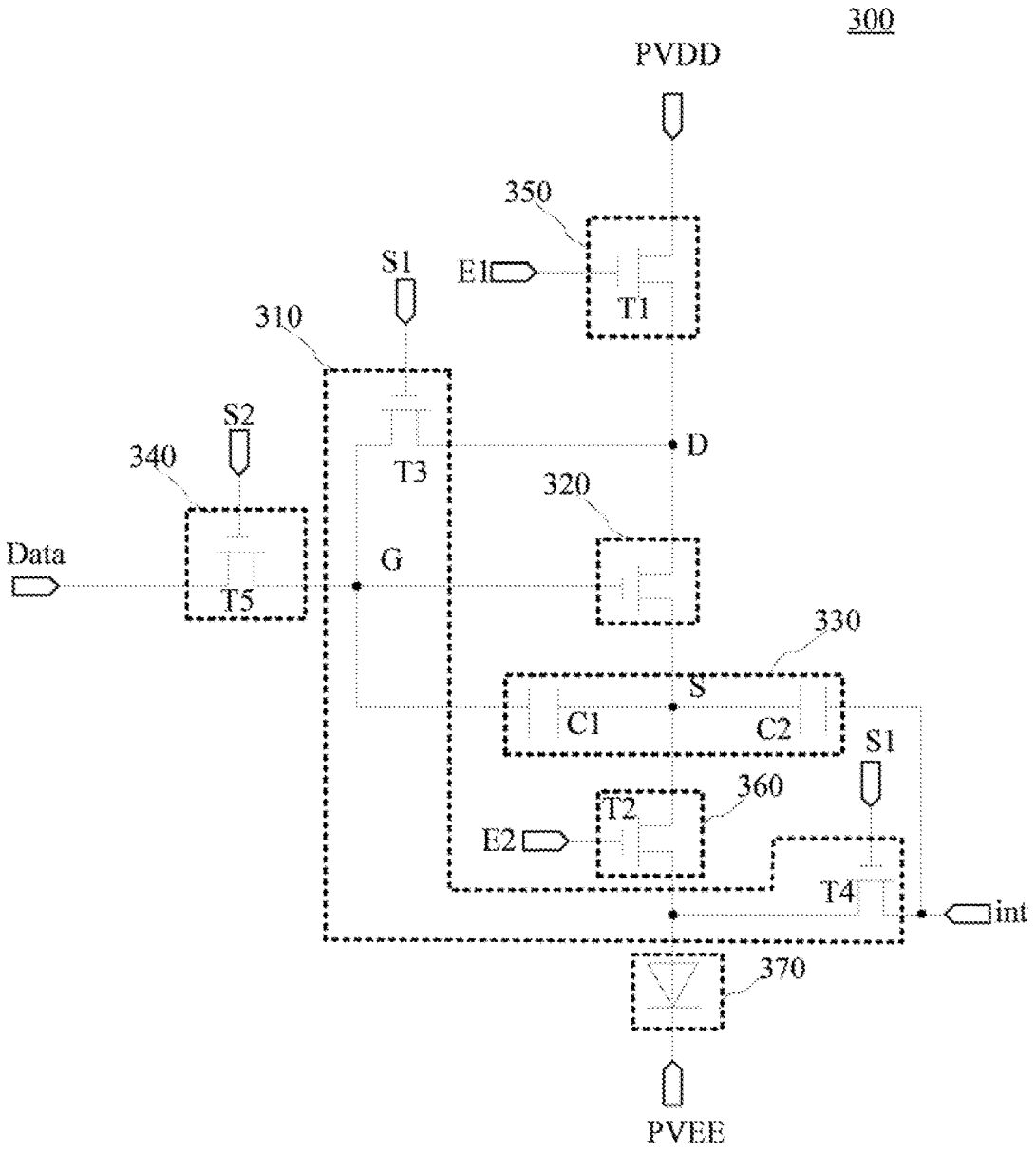
FIG. 4 illustrates another exemplary structural schematic view of an organic light-emitting pixel driving circuit according to embodiments of the present disclosure.

FIG. 4 illustrates another exemplary structural schematic view of an organic light-emitting pixel driving circuit 300 according to embodiments of the present disclosure. As shown in FIG. 4, similar to FIG. 2, the organic light-emitting pixel driving circuit 300 may include an initialization unit 310, a driving transistor 320, a storage unit 330, a data write-in unit 340, a first light-emitting control unit 350, a second light-emitting control unit 360, and a light-emitting element 370.

The organic light-emitting pixel driving circuit 300 may further include a first scanning signal line S1, a second scanning signal line S2, a first light-emitting control signal line E1, and a second light-emitting control signal line E2.

Optionally, the organic light-emitting pixel driving circuit 300 may further include a data line Data, a reference voltage end int, a first power supply voltage end PVDD, and a second power supply voltage end PVEE.

As shown in FIG. 4, the initialization unit 310 may be electrically connected to the first scanning signal line S1 and the reference voltage end int. Under control of a signal carried by the first scanning signal line S1, the initialization unit 310 may transmit a first power supply voltage signal VDD outputted by the first power supply voltage end PVDD to a gate electrode G of the driving transistor 320.

Further, under control of the signal carried by the first scanning signal line S1, the initialization unit 310 may transmit a reference voltage signal Vint outputted by the reference voltage end int to a source electrode S of the driving transistor 320 and an anode of the light-emitting element 370.

The storage unit 330 may include a first capacitor C1 and a second capacitor C2. The first capacitor C1 may be connected between the gate electrode G and the source electrode S of the driving transistor 320. The second capacitor C2 may be connected between the source electrode S of the driving transistor 320 and the reference voltage signal end int. The storage unit 330 may be configured to detect a threshold voltage of the driving transistor 320. Further, the storage unit 330 may be configured to maintain voltage signals transmitted to the gate electrode G and the source electrode S of the driving transistor 320.

Further, a first plate of the first capacitor C1 may be connected to the gate electrode G of the driving transistor 320, and a second plate of the first capacitor C1 may be connected to the source electrode S of the driving transistor 320. Further, different from the second capacitor C2 in the pixel driving circuit in FIG. 2, as shown in FIG. 4, while a first plate of the second capacitor C2 may be still connected to the second plate of the first capacitor C1, a second plate of the second capacitor C2 in FIG. 4 may be connected to the reference voltage signal end int.

The data write-in unit 340 may be connected to the data line Data and the second scanning signal line S2. Under control of a signal carried by the second scanning signal line S2, the data write-in unit 340 may transmit a data voltage signal Vdata carried by the data line Data to the gate electrode G of the driving transistor 320 to compensate the threshold voltage of the driving transistor 320.

The first light-emitting control unit 350 may be connected to the first light-emitting control signal line E1. The second light-emitting control unit 360 may be connected to the second light-emitting control signal line E2. The first light-emitting control unit 350 and the second light-emitting control unit 360 may be configured to control the light-emitting element 370 to emit light. Further, a cathode of the light-emitting element 370 may be connected to the second power supply voltage end PVEE.

The working principles of the organic light-emitting pixel driving circuit in FIG. 4 may also be described in detail hereinafter with reference to the timing sequence shown in FIG. 3. Referring to FIG. 3 and FIG. 4, from the first stage P1 to the fourth stage P4, the second plate of the second capacitor C2 may stay connected to the reference voltage end int. That is, the second plate of the second capacitor C2 may access the reference voltage signal Vint having a fixed voltage level.

Accordingly, the quantity of electric charges stored in the second plate of the second capacitor C2 may not change when the quantity of electric charges stored in the first plate of the second capacitor C2 changes. That is, the quantity of electric charges stored in the second plate of the second capacitor C2 may remain unchanged.

Further, the variance in the voltage levels of the source electrode S, the drain electrode D, and the gate electrode G of the driving transistor 320 in each of the first stage P1, the second stage P2, the third stage P3, and the fourth stage P4 may refer to descriptions provided for FIG. 2. Further, the calculation process of the light-emitting current I that flows through the light-emitting element 370 in the fourth stage P4 may also refer to aforementioned descriptions, and the equation of the light-emitting current I may refer to the equation (10).

Accordingly, in the disclosed organic light-emitting pixel driving circuit, the light-emitting current I may be unrelated to the threshold voltage Vth of the driving transistor 320. Further, referring to equation (10), if the ratio of the capacitance value c1 of the first capacitor C to the capacitance value c2 of the second capacitor C2 remains unchanged, the same light-emitting current I may be obtained when the same data voltage signal Vdata and the same first power supply voltage signal VDD are supplied to the organic light-emitting pixel driving circuit.

Optionally, the light-emitting current I and the light-emitting brightness of the light-emitting element 370 may be adjusted by varying the proportional relationship between the capacitance value c1 of the first capacitor C1 and the capacitance value c2 of the second capacitor C2. Because the evenness of the light-emitting brightness of each light-emitting element may be adjusted by controlling the ratio of the capacitance value c1 of the first capacitor C1 to the capacitance value c2 of the second capacitor C2, the requirements on the processing of the organic light-emitting pixel driving circuit may be reduced.

Further, as described above, when the second plate of the second capacitor C2 is connected to the reference voltage end int instead of the first power supply voltage end PVDD, the light-emitting current I of the light-emitting element 370 may remain the same as the light-emitting current I of the light-emitting element 270. Accordingly, the connection and position of the second capacitor C2 may be adjusted based on specific circuit structure in the organic light-emitting pixel driving circuit. Thus, the layout area occupied by the organic light-emitting pixel driving circuit may be reduced.

Figure 5:
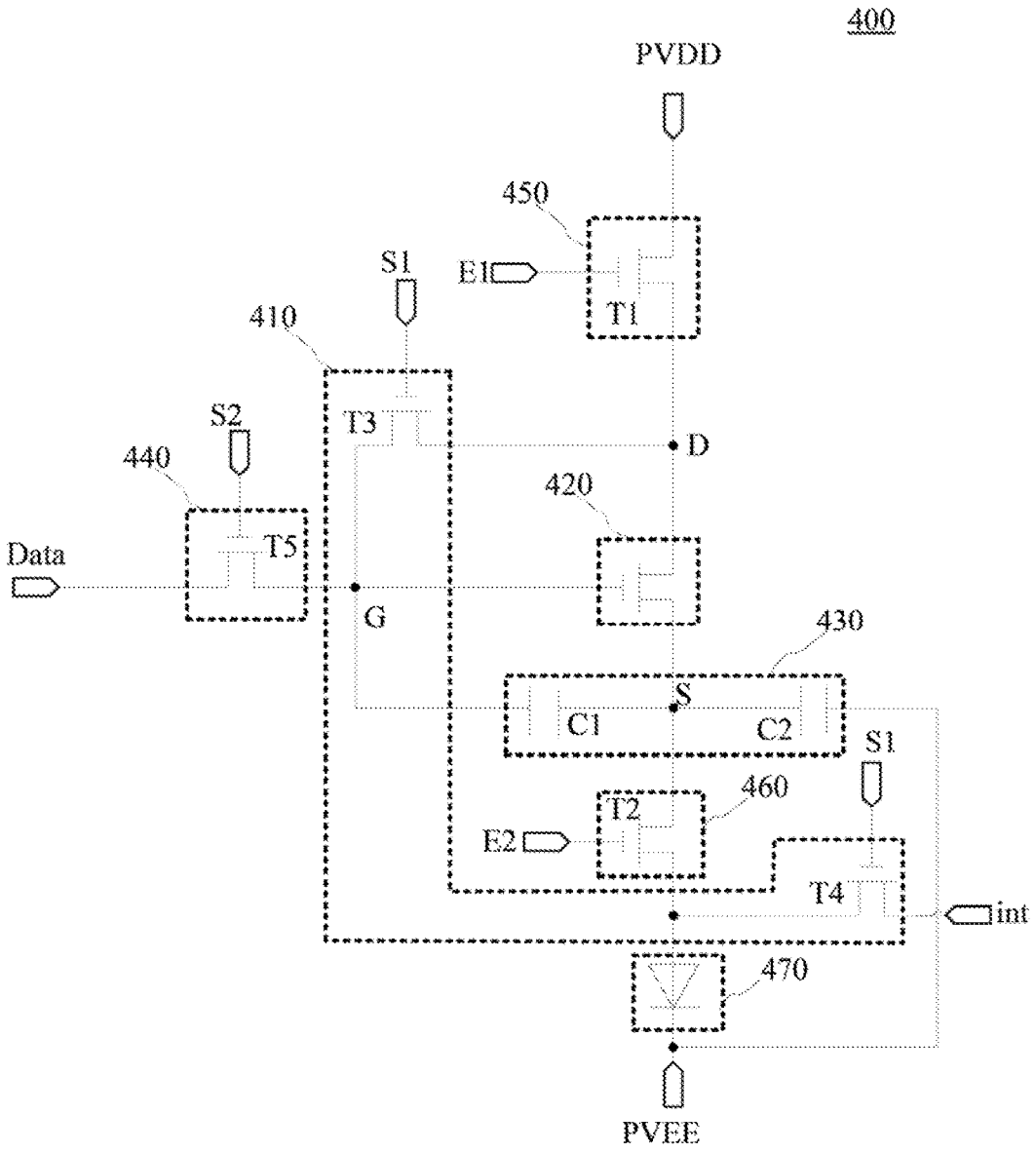
FIG. 5 illustrates another exemplary structural schematic view of an organic light-emitting pixel driving circuit according to embodiments of the present disclosure.

FIG. 5 illustrates another exemplary structural schematic view of an organic light-emitting pixel driving circuit according to embodiments of the present disclosure. As shown in FIG. 5, similar to FIG. 2 and FIG. 4, the organic light-emitting pixel driving circuit 400 may include an initialization unit 410, a driving transistor 420, a storage unit 430, a data write-in unit 440, a first light-emitting control unit 450, a second light-emitting control unit 460, and a light-emitting element 470.

The organic light-emitting pixel driving circuit 400 may further include a first scanning signal line S1, a second scanning signal line S2, a first light-emitting control signal line E1, and a second light-emitting control signal line E2. Optionally, the organic light-emitting pixel driving circuit 400 may further include a data line Data, a reference voltage end int, a first power supply voltage end PVDD, and a second power supply voltage end PVEE.

As shown in FIG. 5, the initialization unit 410 may be electrically connected to the first scanning signal line S1 and the reference voltage end int. Under control of a signal carried by the first scanning signal line S1, the initialization unit 410 may transmit the first power supply voltage signal VDD outputted by the first power supply voltage end PVDD to a gate electrode G of the driving transistor 420.

Further, under control of the signal carried by the first scanning signal line S1, the initialization unit 410 may transmit a reference voltage signal Vint outputted by the reference voltage end int to a source electrode S of the driving transistor 420 and an anode of the light-emitting element 470.

The storage unit 430 may include a first capacitor C1 and a second capacitor C2. The first capacitor C1 may be connected between the gate electrode G and the source electrode S of the driving transistor 420. The second capacitor C2 may be connected between the source electrode S of the driving transistor 420 and the second power supply voltage end PVEE.

The data write-in unit 440 may be connected to the data line Data and the second scanning signal line S2. Under control of a signal carried by the second scanning signal line S2, the data write-in unit 440 may transmit a data voltage signal Vdata carried by the data line Data to the gate electrode G of the driving transistor 420. The data voltage signal Vdata may be configured to compensate the threshold voltage of the driving transistor 420.

The first light-emitting control unit 450 may be connected to the first light-emitting control signal line E1. The second light-emitting control unit 460 may be connected to the second light-emitting control signal line E2. The first light-emitting control unit 450 and the second light-emitting control unit 460 may control the light-emitting element 470 to emit light. Further, a cathode of the light-emitting element 470 may be connected to the second power supply voltage end PVEE.

Different from FIG. 2 and FIG. 4, in the first capacitor C1 and the second capacitor C2 included in the storage unit 430 that is shown in FIG. 5, while the first plate of the second capacitor C2 is still connected to the second plate of the first capacitor C1, the second plate of the second capacitor C2 in FIG. 5 may be connected to the second power supply voltage end PVEE.

The working principles of the organic light-emitting pixel driving circuit in FIG. 5 may also be described in detail hereinafter with reference to the timing sequence shown in FIG. 3. Referring to FIG. 3 and FIG. 5, from the first stage P1 to the fourth stage P4, the second plate of the second capacitor C2 may stay connected to the second power supply voltage end PVEE. That is, the second plate of the second capacitor C2 may access the second voltage level signal VEE with a fixed voltage level.

Accordingly, the quantity of electric charges stored in the second plate of the second capacitor C2 may not vary with the variance in the quantity of electric charges stored in the first plate of the second capacitor C2. That is, the quantity of electric charges stored in the second plate of the second capacitor C2 may remain unchanged.

Further, the variance in the voltage levels of the source electrode S, the drain electrode D, and the gate electrode G of the driving transistor 420 in each of the first stage P1, the second stage P2, the third stage P3, and the fourth stage P4 may refer to descriptions provided for FIG. 2. Further, the calculation process of the light-emitting current I that flows through the light-emitting element 470 in the fourth stage P4 may also refer to aforementioned descriptions, thereby obtaining the same expression of the light-emitting current I as shown in equation (10).

Accordingly, in the disclosed organic light-emitting pixel driving circuit, the light-emitting current I may be unrelated to the threshold voltage Vth of the driving transistor 420. Further, referring to equation (10), if the ratio of the capacitance value c1 of the first capacitor C1 to the capacitance value c2 of the second capacitor C2 remains unchanged, the same light-emitting current I may be obtained as long as the same data voltage signal Vdata and the same first power supply voltage signal VDD are supplied to the organic light-emitting pixel driving circuit.

Optionally, the light-emitting current I and the light-emitting brightness of the light-emitting element 470 may be adjusted by varying the proportional relationship between the capacitance value c1 of the first capacitor C1 and the capacitance value c2 of the second capacitor C2. Because the evenness of the light-emitting brightness of each light-emitting element may be adjusted by controlling the ratio of the capacitance value c1 of the first capacitor C1 to the capacitance value c2 of the second capacitor C2, the requirements on the processing of the organic light-emitting pixel driving circuit may be lowered.

Often, an organic light-emitting display panel may include an array substrate, an anode layer, a light-emitting material layer, a cathode layer, and an encapsulation layer. The anode layer may be disposed above the array substrate, and the light-emitting material layer may be disposed on the anode layer facing away the array substrate. The cathode layer may be disposed on the light-emitting material layer facing away the anode layer, and the encapsulation layer may be disposed on the cathode layer facing away the light-emitting material layer.

For example, the cathode layer may be connected to the second power supply voltage end PVEE. By using the organic light-emitting pixel driving circuit illustrated in FIG. 5, the second plate of the second capacitor C2 may be connected to the cathode layer, thereby implementing the connection between the second plate of the second capacitor C2 and the second power supply voltage end PVEE.

More specifically, the second plate of the second capacitor C2 may be connected to the cathode layer via a through-hole. Because the second plate of the second capacitor C2 is connected to the cathode layer of the organic light-emitting display panel via the through-hole, a wire connecting to the second plate of the second capacitor C2 may no longer need to be disposed on the array substrate. Accordingly, the layout area occupied by the organic light-emitting pixel driving circuit may be reduced.

Figure 6:
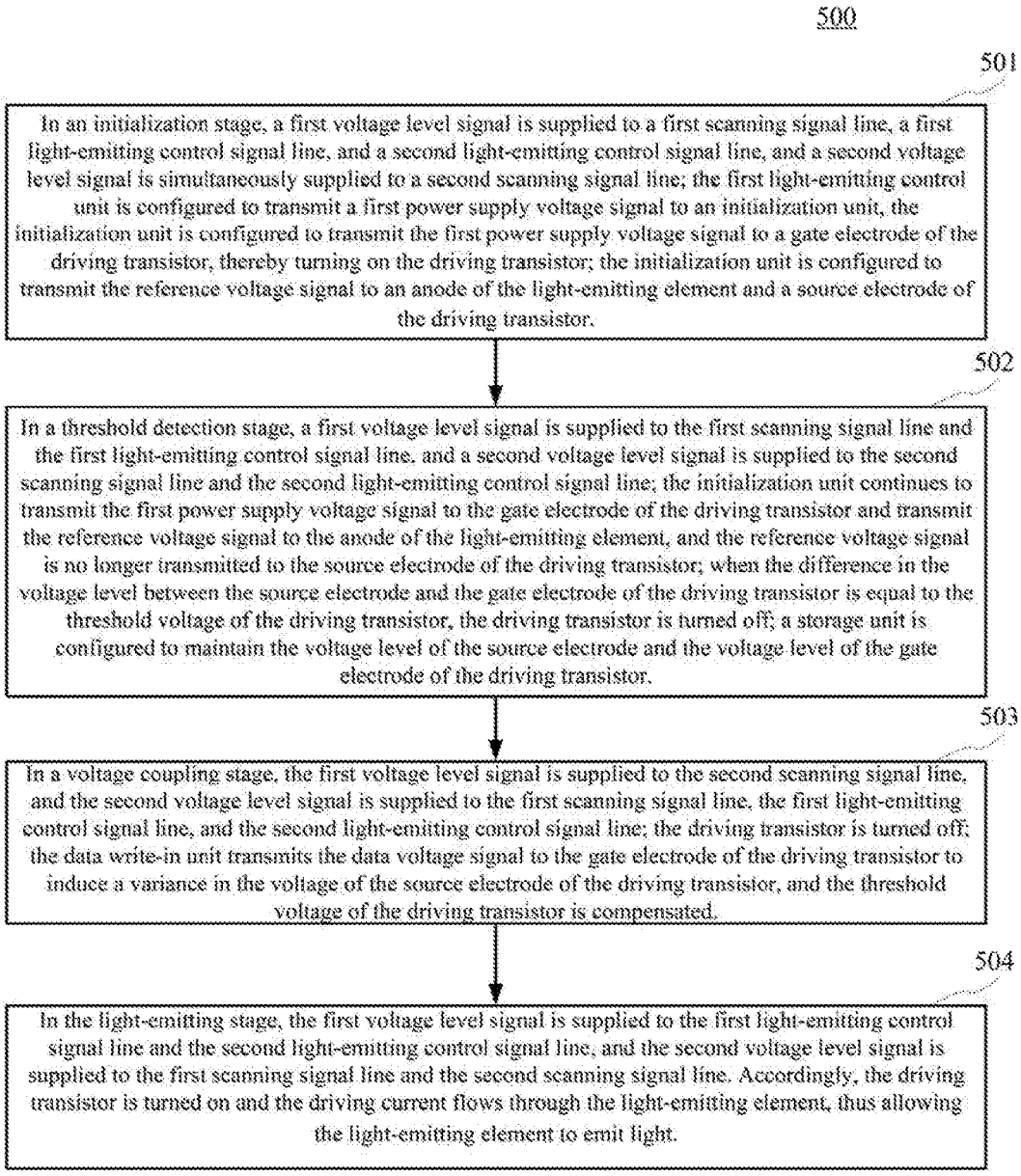
FIG. 6 illustrates an exemplary flow chart of a driving method for driving an organic light-emitting pixel driving circuit according to embodiments of the present disclosure.

The present disclosure also provides a driving method of an organic light-emitting pixel driving circuit. The driving method may be configured to drive any aforementioned organic light-emitting pixel driving circuit. FIG. 6 illustrates an exemplary flow chart 500 of a driving method for driving an organic light-emitting pixel driving circuit according to embodiments of the present disclosure. As shown in FIG. 6, the driving method may include the following steps.

Step 501, in an initialization stage, a first voltage level signal may be supplied to a first scanning signal line, a first light-emitting control signal line, and a second light-emitting control signal line. Further, a second voltage level signal may be supplied to a second scanning signal line.

The first light-emitting control unit may be configured to transmit a first power supply voltage signal to an initialization unit. The initialization unit may be configured to transmit the first power supply voltage signal to a gate electrode of the driving transistor, thereby resetting the gate electrode of the driving transistor.

Further, the initialization unit may be configured to transmit the reference voltage signal to an anode of the light-emitting element and a source electrode of the driving transistor, thereby resetting the light-emitting element.

Step 502, in a threshold detection stage, a first voltage level signal may be supplied to the first scanning signal line and the first light-emitting control signal line, and a second voltage level signal may be supplied to the second scanning signal line and the second light-emitting control signal line.

In the threshold detection stage, the initialization unit may continue to transmit the first power supply voltage signal to the gate electrode of the driving transistor and transmit the reference voltage signal to the anode of the light-emitting element. The initialization unit may no longer transmit the reference voltage signal to the source electrode of the driving transistor. Accordingly, the voltage level of the source electrode of the driving transistor may be raised.

When the difference in the voltage level between the source electrode and the gate electrode of the driving transistor is equal to the threshold voltage of the driving transistor, the driving transistor may be turned off. A storage unit may be configured to maintain the voltage level of the source electrode and the voltage level of the gate electrode of the driving transistor, thereby fulfilling the detection of the threshold voltage of the driving transistor.

Step 503, in a voltage coupling stage, the first voltage level signal may be supplied to the second scanning signal line, and the second voltage level signal may be supplied to the first scanning signal line, the first light-emitting control signal line, and the second light-emitting control signal line.

In the voltage coupling stage, the driving transistor may be turned off. Further, the data write-in unit may transmit the data voltage signal to the gate electrode of the driving transistor, and the data voltage signal may compensate the threshold voltage of the driving transistor. More specifically, in the voltage coupling stage, the voltage signal of the gate electrode of the driving transistor may change from the first power supply voltage signal to the data voltage signal, thereby inducing a change in the voltage level of the source electrode of the driving transistor. Accordingly, the compensation of the threshold voltage of the driving transistor may be implemented.

Step 504, in a light-emitting stage, the first voltage level signal may be supplied to the first light-emitting control signal line and the second light-emitting control signal line, and the second voltage level signal may be supplied to the first scanning signal line and the second scanning signal line. Accordingly, the driving transistor may be turned on. Further, the driving current may flow through the light-emitting element, thus allowing the light-emitting element to emit light.

When the disclosed driving method of the organic light-emitting pixel driving circuit is applied to an organic light-emitting pixel driving circuit illustrated in FIG. 2, FIG. 4, or FIG. 5, the timing sequence of each signal in Step 501~Step 504 may refer to FIG. 3.

Optionally, in the disclosed driving method, the voltage level of the reference voltage signal outputted by the reference voltage end may be lower than the voltage level of the first power supply voltage signal outputted by the first power supply voltage end. As such, a leakage current may not be generated because the voltage applied to the anode of the light-emitting element is greater than the voltage applied to the cathode of the light-emitting element.

Accordingly, the light-emitting element may not emit light because of the generation of the leakage current. Thus, the dark state display effect of the organic light-emitting pixel driving circuit and the display panel that apply the disclosed driving method may be improved.

Figure 7:
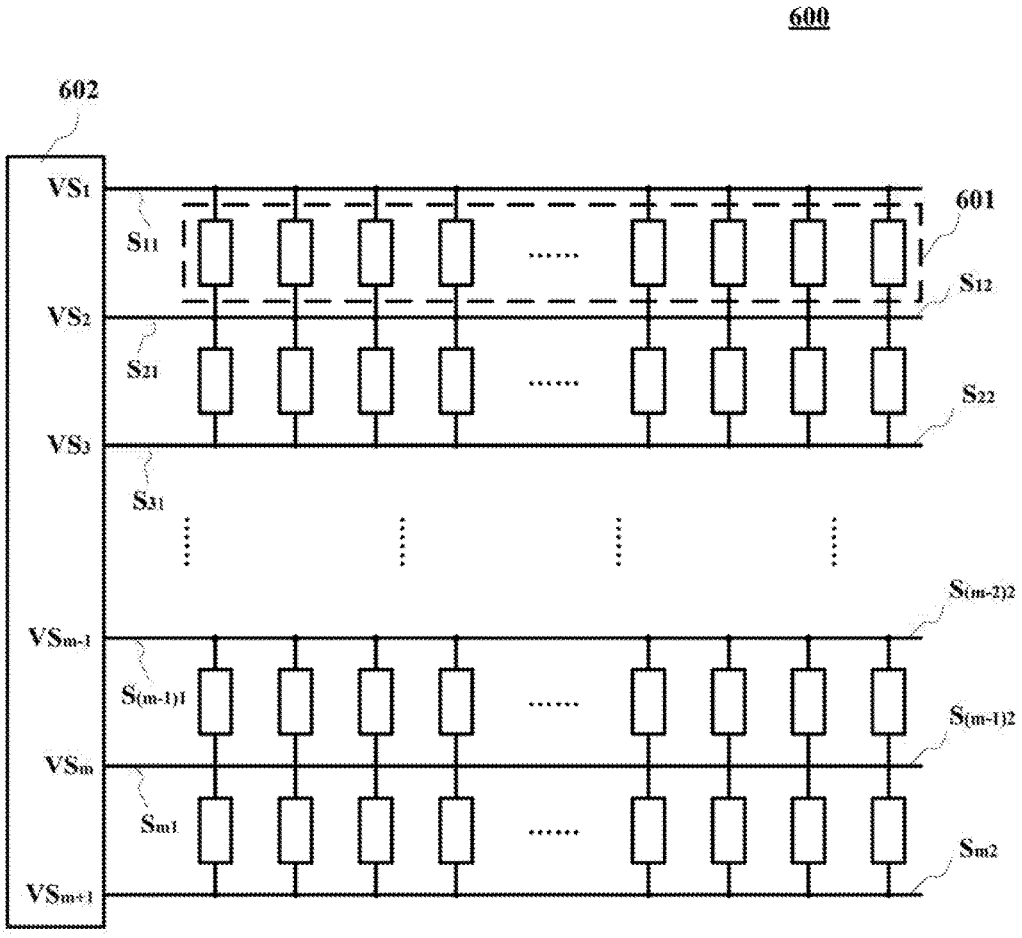
FIG. 7 illustrates an exemplary organic light-emitting display panel according to embodiments of the present disclosure.

FIG. 7 illustrates an exemplary organic light-emitting display panel 600 according to embodiments of the present disclosure. As shown in FIG. 7, the organic light-emitting display panel 600 may include a plurality of rows of pixel units 601, and a shift register 602. Each row of pixel units 601 may include a plurality of pixel units. Each pixel unit may include one organic light-emitting pixel driving circuit as described above.

Further, the organic light-emitting display panel 600 may include a plurality of first scanning signal lines $S_{11}$, $S_{21}$, . . . , $S_{m1}$, and a plurality of second scanning signal lines $S_{12}$, $S_{22}$, . . . , $S_{m2}$. Each row of pixel units 601 may be connected to one first scanning signal line and one second scanning signal line. In one embodiment, as shown in FIG. 7, in the organic light-emitting display panel 600, an m row of pixel units 601 may be connected to a first scanning signal line $S_{m1}$ and a second scanning signal line $S_{m+1}$, where m is a positive integer. For example, the first row of pixel units 601 may be connected to a first scanning signal line S11 and a second scanning signal line 512.

Further, as shown in FIG. 7, the shift register 602 may include m+1 cascade-connected shift register units $VS_1$, $VS_2$, $VS_3$, . . . , $VS_m$, and $VS_{m+1}$. Except the last-stage shift register unit $VS_{m+1}$, other shift register unit ($VS_1$, $VS_2$, $VS_3$, . . . , and $VS_m$) may be each connected to one first scanning signal line connected to a corresponding row of pixel units, and transmit a first scanning signal to the one first scanning signal line. For example, the shift register unit $VS_m$ may be connected to the first scanning signal line $S_{m1}$ and transmit a first scanning signal to the first scanning signal line $S_{m1}$.

Further, referring to FIG. 3, in the first scanning signal line and the second scanning signal line connected to the same pixel unit (i.e., the same row of pixel units), the second scanning signal carried by the second scanning signal line may be delayed by a signal period with respect to the first scanning signal carried by the first scanning signal line.

Accordingly, except the first scanning signal lines $S_{11}$ connected to the first row of pixel units 601, other first scanning signal lines ($S_{21}$, . . . , $S_{m1}$) may each share a same line with a corresponding second scanning signal line. For example, the first scanning signal line $S_{m1}$ connected to the $m^{th}$ row of pixel units 601 may share a line with a second scanning signal line $S_{(m-1)2}$ connected to the $(m-1)^{th}$ row of pixel units 601.

That is, a second scanning signal line corresponding to an $i^{th}$ row of pixel units may be multiplexed as a first scanning signal line corresponding to an $(i+1)^{th}$ row of pixel units, where i is a positive integer greater than or equal to 1. Further, i may be smaller than the total number N of rows of pixel units in the organic light-emitting display panel (i.e., $i<N$).

That is, a first scanning signal transmitted by a first scanning signal line (except the first scanning signal line $S_{11}$) connected to one row of pixel units to each pixel unit in the one row of pixel units may be multiplexed as a second scanning signal transmitted to each pixel unit in a previous row of pixel units. For example, a first scanning signal transmitted by the first scanning signal line $S_{m1}$ to the $^{th}$ row of pixel units 601 may be multiplexed as a second scanning signal transmitted to the $(m-1)^{th}$ row of pixel units 601.

By multiplexing the first scanning signal lines ($S_{21}$, . . . , $S_{m1}$) as corresponding second scanning signal lines each connects to one row of pixel units, the layout area occupied by the pixel driving circuit in the display panel may be reduced. Accordingly, the implementation of high pixels per inch (PPI) display panel may be facilitated.

Further, by using the disclosed organic light-emitting pixel driving circuit, the compensation of a threshold voltage of the driving transistor may be realized. Accordingly, the brightness evenness of the organic light-emitting display panel may be improved.

It should be noted that, the above detailed descriptions illustrate only preferred embodiments of the present disclosure and technologies and principles applied herein. Those skilled in the art can understand that the present disclosure is not limited to the specific embodiments described herein, and numerous significant alterations, modifications and alternatives may be devised by those skilled in the art without departing from the scope of the present disclosure. Thus, although the present disclosure has been illustrated in above-described embodiments in details, the present disclosure is not limited to the above embodiments. Any equivalent or modification thereof, without departing from the spirit and principle of the present invention, falls within the true scope of the present invention, and the scope of the present disclosure is defined by the appended claims.

What is claimed is:

1. An organic light-emitting pixel driving circuit, comprising:

a light-emitting element;

a driving transistor, configured to drive the light-emitting element;

an initialization unit, configured to transmit a first power supply voltage signal to a gate electrode of the driving transistor and transmit a reference voltage signal to a source electrode of the driving transistor and an anode of the light-emitting element;

a storage unit, including a first capacitor and a second capacitor, configured to maintain a voltage signal transmitted to the driving transistor;

a data write-in unit, configured to transmit a data voltage signal to the gate electrode of the driving transistor and allow the data voltage signal to compensate a threshold voltage of the driving transistor; and a light-emitting control unit, configured to control the light-emitting element to emit light, wherein:

a first plate of the first capacitor is connected to the gate electrode of the driving transistor, and a second plate of the first capacitor is connected to the source electrode of the driving transistor, and a first plate of the second capacitor is connected to the source electrode of the driving transistor, and a second plate of the second capacitor accesses a fixed voltage.

2. The organic light-emitting pixel driving circuit according to claim 1, wherein:

the light-emitting control unit includes a first light-emitting control unit and a second light-emitting control unit.

3. The organic light-emitting pixel driving circuit according to claim 2, further comprising:

a data line, configured to output the data voltage signal;

a first scanning signal line, configured to carry a signal that controls the initialization unit;

a second scanning signal line, configured to carry a signal that controls the date write-in unit;

a first light-emitting control signal line connected to the first light-emitting control unit, a second light-emitting control signal line connected to the second light-emitting control unit, a first power supply voltage end, configured to output the first power supply voltage signal, and a second power supply voltage end, configured to output a second power supply voltage signal.

4. The organic light-emitting pixel driving circuit according to claim 3, wherein:

the first light-emitting control unit includes a first transistor, a gate electrode of the first transistor is connected to the first light-emitting control signal line, a first electrode of the first transistor is connected to the first power supply voltage end, and a second electrode of the first transistor is connected to a drain electrode of the driving transistor.

5. The organic light-emitting pixel driving circuit according to claim 4, wherein:

the second light-emitting control unit includes a second transistor, a gate electrode of the second transistor is connected to the second light-emitting control signal line, a first electrode of the second transistor is connected to the source electrode of the driving transistor, and a second electrode of the second transistor is connected to the anode of the light-emitting element.

6. The organic light-emitting pixel driving circuit according to claim 5, wherein:

the initialization unit includes a third transistor and a fourth transistor, a gate electrode of the third transistor is connected to the first scanning signal line, a first electrode of the third transistor is connected to the second electrode of the first transistor, and a second electrode of the third transistor is connected to the gate electrode of the driving transistor, and a gate electrode of the fourth transistor is connected to the first scanning signal line, a first electrode of the fourth transistor is connected to a reference voltage end, and a second electrode of the fourth transistor is connected to the anode of the light-emitting element and the second electrode of the second transistor.

7. The organic light-emitting pixel driving circuit according to claim 6, wherein:

the second plate of the second capacitor is connected to the first power supply voltage end.

8. The organic light-emitting pixel driving circuit according to claim 7, wherein:

the data write-in unit includes a fifth transistor, and a gate electrode of the fifth transistor is connected to the second scanning signal line, a first electrode of the fifth transistor is connected to the data line, and a second electrode of the firth transistor is connected to the driving transistor.

9. The organic light-emitting pixel driving circuit according to claim 1, wherein:

the light-emitting element is an organic light-emitting diode.

10. The organic light-emitting pixel driving circuit according to claim 3, wherein:

a capacitance value of the second capacitor is greater than a capacitance value of the first capacitor.

11. The organic light-emitting pixel driving circuit according to claim 3, wherein:

a signal carried by the first light-emitting control signal line is obtained by converting phase of a signal carried by the second scanning signal line via a phase inverter.

12. The organic light-emitting pixel driving circuit according to claim 6, wherein:

the second plate of the second capacitor is connected to the second power supply voltage end.

13. The organic light-emitting pixel driving circuit according to claim 6, wherein:

the second plate of the second capacitor is connected to the reference voltage end.

14. An organic light-emitting display panel, comprising:

a plurality of rows of pixel units, wherein each row of the plurality of rows of pixel units comprises a plurality of organic light-emitting pixel driving circuits, and an organic light-emitting pixel driving circuit comprises:

a light-emitting element;

a driving transistor, configured to drive the light-emitting element;

an initialization unit, configured to transmit a first power supply voltage signal to a gate electrode of the driving transistor and transmit a reference voltage signal to a source electrode of the driving transistor and an anode of the light-emitting element;

a storage unit, including a first capacitor and a second capacitor, configured to maintain a voltage signal transmitted to the driving transistor;

a data write-in unit, configured to transmit a data voltage signal to the gate electrode of the driving transistor, and allow the data voltage signal to compensate a threshold voltage of the driving transistor; and a light-emitting control unit, configured to control the light-emitting element to emit light, wherein:

a first plate of the first capacitor is connected to the gate electrode of the driving transistor, and a second plate of the first capacitor is connected to the source electrode of the driving transistor, and a first plate of the second capacitor is connected to the source electrode of the driving transistor, and a second plate of the second capacitor accesses a fixed voltage.

15. The organic light-emitting display panel according to claim 14, wherein:

the plurality of rows of pixel units is each connected to a first scanning signal line and a second scanning signal line.

16. The organic light-emitting display panel according to claim 15, wherein:

a second scanning signal line connected to an $i^{th}$ row of pixel units is multiplexed as a first scanning signal line connected to an $(i+1)^{th}$ row of pixel units, where i is a positive integer.

17. A driving method for driving an organic light-emitting pixel driving circuit, wherein the organic light-emitting pixel driving circuit includes a light-emitting element, a driving transistor, an initialization unit under control of a first scanning signal line, a storage unit, a data write-in unit under control of a second scanning signal line, a first light-emitting control unit under control of a first light-emitting control signal line, and a second light-emitting control unit under control of a second light-emitting control signal line, the driving method comprising:

in an initialization stage, providing a first voltage level signal to the first scanning signal line, the first light-emitting control signal line, and the second light-emitting control signal line; and providing a second voltage level signal to the second scanning signal line, wherein the first light-emitting control unit and the initialization unit transmit a first power supply voltage signal to a gate electrode of the driving transistor, and the initialization unit transmits a reference voltage signal to an anode of the light-emitting element and a source electrode of the driving transistor.

18. The driving method according to claim 17, further comprising:

in a threshold detection stage, providing the first voltage level signal to the first scanning signal line and the first light-emitting control signal line; and providing the second voltage level signal to the second scanning signal line and the second light-emitting control signal line, wherein the first power supply voltage signal is transmitted to the gate electrode of the driving transistor, the reference voltage signal is transmitted to the anode of the light-emitting element but not to the source electrode of the driving transistor, a voltage level of the source electrode of the driving transistor is raised to a value that differs by a threshold voltage of the driving transistor with respect to a voltage level of the gate electrode of the driving transistor, such that the driving transistor is turned off, and voltage levels of the source and gate electrodes of the driving transistor are maintained.

19. The driving method according to claim 18, further comprising:

in a voltage coupling stage, providing the first voltage level signal to the second scanning signal line, and providing the second voltage level signal to the first scanning signal line, the first light-emitting control signal line and the second light-emitting control signal line, such that the driving transistor is turned off, a data voltage signal is transmitted to the gate electrode of the driving transistor, and the threshold voltage of the driving transistor is compensated, and in a light-emitting stage, providing the first voltage level signal to the first and second light-emitting control signal lines, and providing the second voltage level signal to the first and second scanning signal lines, such that the driving transistor is turned on to allow the light-emitting element to emit light.

20. The driving method according to claim 19, wherein:

a voltage level of the reference voltage signal is lower than a voltage level of the second power supply voltage signal.

* * * * *